United States Patent [19]

Ishii et al.

[11] 4,364,796

[45] Dec. 21, 1982

[54] METHOD AND SYSTEM FOR DISPOSING PYROLYSIS GAS

[75] Inventors: Yoshiaki Ishii; Naoyoshi Ando; Tsutomu Kume; Shosaku Fujinami, all of Yokohama, Japan

[73] Assignee: Seiichi Ishizaka, President of Agency of Industrial Science and Technology, Tokyo, Japan

[21] Appl. No.: 224,832

[22] Filed: Jan. 13, 1981

[30] Foreign Application Priority Data

Jan. 18, 1980 [JP] Japan ..... 55-3578

[51] Int. Cl.[3] ..... C10B 21/10

[52] U.S. Cl. ..... 201/4; 201/1; 201/16; 201/29; 201/31; 202/151

[58] Field of Search ..... 201/2.5, 1, 4, 12, 3, 201/13, 16, 15, 14, 20, 29, 31; 202/151

[56] References Cited

U.S. PATENT DOCUMENTS

| | | | |
|---|---|---|---|
| 3,703,442 | 11/1972 | Rammler et al. | 201/12 |
| 3,736,233 | 5/1973 | Sass et al. | 201/20 |
| 3,853,498 | 12/1974 | Bailie | 201/2.5 |
| 3,887,461 | 6/1975 | Nickerson | 201/2.5 |
| 4,206,186 | 6/1980 | Holter et al. | 201/2.5 |

*Primary Examiner*—Norman Yudkoff

*Attorney, Agent, or Firm*—Wenderoth, Lind & Ponack

[57] ABSTRACT

A method and a system for disposing of the pyrolysis gas generated in a pyrolyzing system to refine the same are presented in which an absorbing agent for eliminating harmful gas is introduced into a thermal reactor in such an amount that a large percent of such agent is unreacted but it is efficiently recovered together with char from the pyrolysis gas and also these recovered materials are utilized to remove oil and tar from water used in cleaning the pyrolysis gas, the recovered solid particles of the char and unreacted absorbing agent and the oil and tar separated from the cleaning water being recirculated in the pyrolyzing system.

3 Claims, 2 Drawing Figures

METHOD AND SYSTEM FOR DISPOSING PYROLYSIS GAS

FIELD OF INVENTION

The present invention relates to a method and a system for disposing of gas generated in a reactor adapted to pyrolyze organic materials such as municipal waste or the like and for providing cleaned gas. More specifically, the present invention relates to such method and system as above in which reusable minute particles are effectively recovered from the cleaning medium used for refining the pyrolysis gas so that the total operating efficiency of the system is improved.

BACKGROUND OF INVENTION

Due to the rapid increase in quantity of municipal waste, several approaches for disposing of municipal waste have been proposed and, in fact, some of them have been put into practice. Among those, thermal disposal such as incineration and/or pyrolysis has proved to be satisfactory to some extent. The pyrolyzing process is particularly, useful in the point that it provides pyrolysis gas as fuel from the waste to be discarded. However, municipal waste contains many constituents and they may generate harmful gas such as HCl, $H_2S$, SOx, etc. when they contain vinyl chloride, etc. and are pyrolyzed in a thermal reactor such as a fluidized bed. Such harmful gas erodes the apparatus and/or creates the problem of environmental pollution.

In order to minimize such drawbacks or to eliminate the harmful gas, materials reacting with the harmful gas to produce harmless compounds have heretofore been supplied to a pyrolyzing reactor. Suitable materials for such purpose are compounds of alkali earth metals such as dolomite, quick lime and slaked lime, etc.

There are several ways for supplying such compounds of alkali earth metals (hereinafter simply referred to as "absorbing agent"). For instance, the absorbing agent comprising particles ranging in size from approximately 1 m/m to 5 m/m is charged to a fluidizing bed; powdery absorbing agent having particle size below 0.5 m/m is charged either to a free boad portion in a fluidized reactor or to the fluidized bed. In any of the processes for supplying the absorbing agent, it is necessary, in order to effectively eliminate harmful gas, to supply the absorbing agent in a quantity 4 or 5 times, in equivalent, the quantity of "Cl" contained in the material or waste to be pyrolyzed. Accordingly, in the prior art for charging the agent, only approximately 20% of the charged absorbing agent is effectively utilized and the rest thereof, i.e. approximately 80% of the charged agent is discharged out of the system without being reacted and utilized thereby wasting a considerable proportion of the absorbing agent.

Therefore, the general practice has been to charge the recovered absorbing agent together with dust and char collected at a dry type collector such as cyclone. However, the dry type collector can not collect all the particles of the absorbing agent, etc. because some are of a size below the collecting capacity of the dry type collector. Therefore, particles of the absorbing agent not trapped by the dry type collector are subjected to a wet type cleaning process so that they are separated together with liquid or water from the generated pyrolysis gas. However, the pyrolysis gas generated carries other foreign matter or impurities such as oil, tar or the like which remain therein as unvaporized or ungasified residue and these items are also picked up by the cleaning water from the pyrolysis gas. In the wet type collector, the solid particles of the char and absorbing agent and a part of the oil and tar aggregate and settle in the water from which they are easily separated from the water to be discharged. However, the rest of the oil and tar in the cleaning water remain floating on the surface of the water or suspended in the water, because the amount of the tar and oil is relatively rich compared to that of the solid items introduced and involved in the cleaning water. Thus, it has been quite difficult to separate those floating and suspended oil and tar components from the water, so the discharged water is likely to be contaminated with these particles.

SUMMARY OF INVENTION

Accordingly, it is an object of the present invention to provide a method and a system for effectively refining pyrolysis gas.

It is also an object of the present invention to save the consuming amount of the absorbing agent to be utilized for eliminating and/or reducing the harmful gas contained in the pyrolysis gas.

It is still a further object of the present invention to raise the recovery rate of the oil and tar in the pyrolyzing system.

It is another object of the present invention to simplify the apparatus to be used for removing oil and tar from the pyrolyzing system.

According to the present invention, the objects above are achieved by a method in which solid particles of char and unreacted absorbing agent collected from the pyrolysis gas are intentionally utilized to promote separation of oil and tar in an oil separating tank. Further, the collected solid particles and oil and tar are reutilized in the pyrolyzing system so as to raise the efficiency of the total system.

The present invention as well as its further effects and advantages will be made clear in the detailed description of the preferred embodiment which follows the brief explanation of the drawings summarized below.

DETAILED DESCRIPTION OF PREFERRED EMBODIMENTS

Figure 1:
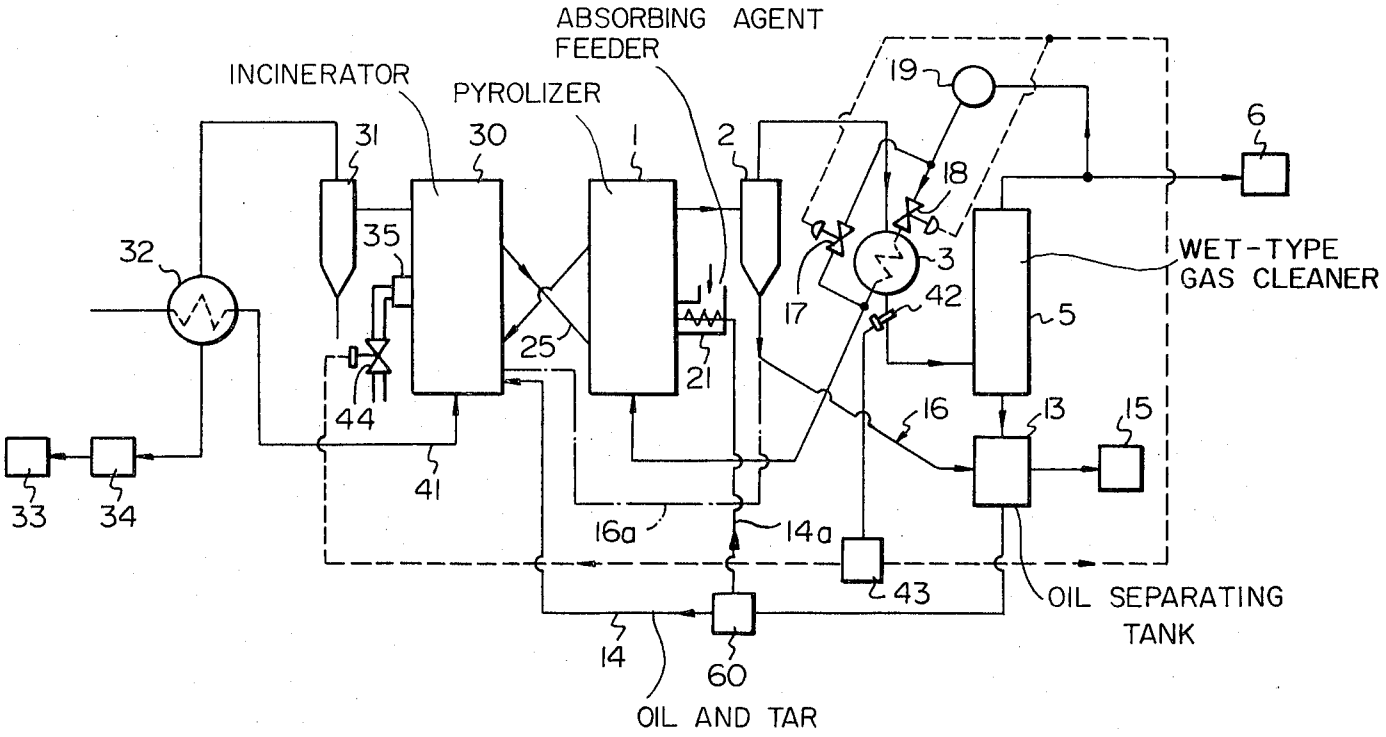
FIG. 1 is a schematic illustration of the pyrolyzing system incorporating a gas disposing system according to the present invention.

Referring now to FIG. 1 wherein a thermal reacting system or pyrolyzing system is schematically illustrated in which a disposing system for pyrolysis gas according to the present invention is incorporated. The pyrolyzing system of FIG. 1 comprises a twin-bed type pyrolyzing apparatus including a pyrolyzing reactor or pyrolyzer 1 and an incinerator 30 which are coupled with each other through conduits 25 and a thermal medium i.e. sand, is circulated within the twin-bed type pyrolyzing apparatus. Municipal waste including organic materials is charged into the pyrolyzer 1 together with the absorbing agent from a feeder 21. The pyrolyzed gas and other products generated by the thermal reaction in the reactor or pyrolyzer 1 are discharged from the upper portion of the reactor 1 and the sand, (the temperature of which is lowered by endothermic reaction in the pyrolyzer 1,) is forwarded to the incinerator 30 through the conduit 25 in which carbon such as char produced during the pyrolyzing is burnt to raise the temperature of the sand thereby regenerating the sand. An auxiliary burner 35 is provided to aid the burning of the char in the incinerator 30 in case the amount of char (introduced into the incinerator 30 from the pyrolysis reactor 1) is not sufficient to raise the temperature of the sand. The sand, after its temperature has been raised in the incinerator 30 is again forwarded to the pyrolysis reactor or pyrolyzer 1 for circulation. Fluidization of the pyrolyzer 1 is effected by feeding oxygen-free gas such as part of the generated pyrolysis gas under pressure while the fluidization of the incinerator 30 is effected by feeding air through a line 41 under pressure thereinto, the air being preferably pre-heated by a heat-exchanger 32 through which exhaust gas passed through a dust collector 31 from the incinerator 30 is fed to raise the temperature of the air fed through the line 41. After passing through the heat-exchanger the exhaust gas is further fed to a cleaner 34 and another exhaust gas processor 33 such as a scrubber.

The pyrolysis gas discharged from the upper portion of the pyrolyzer 1 is directed to a collector 2 such as a cyclone where solid particles such as char generated in the pyrolysis reactor and the unreacted absorbing agent are partially or mostly removed. The pyrolysis gas passed through the collector 2 is thence passed through a heat-exchanger 3 and further fed to a wet type gas cleaner or a cooling-absorbing tower 5 which serves to pick up materials or solid particles contained in the gas in liquid or cleaning water. The char and unreacted absorbing agent not trapped in the collector 2 together with the oil and tar or the like are removed from the pyrolysis gas in the tower 5.

The pyrolysis gas cleaned as above is utilized as a source of thermal energy in utilizing facility generally indicated at a reference 6. However, as touched upon earlier, part of it may be pressurized by a compressor or blower 19 and utilized as fluidizing gas for the pyrolyzer 1 and such fluidizing gas is, before entering into the pyrolysis reactor 1, passed through the heat-exchanger 3 so as to pre-heat the fluidizing gas by the thermal energy retained in the pyrolysis gas.

The char, absorbing agent, oil, and tar separated from the pyrolysis gas are taken up by the cleaning water in the tower 5, as will be explained in connection with FIG. 2, and discharged from the tower 5 with a part of the cleaning water to an oil separating tank 13 where they are separated from the cleaning water so that the water comes to meet the acceptable criteia for drainage.

Figure 2:
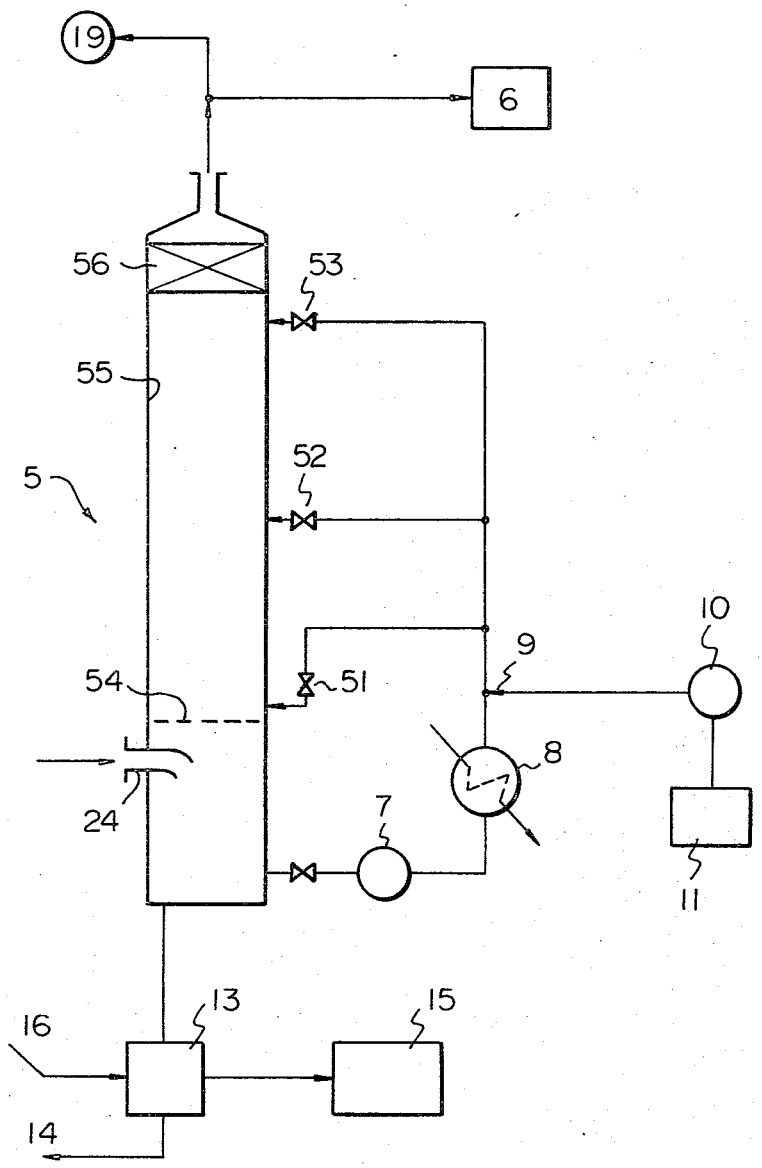
FIG. 2 is a schematic illustration of a wet type gas cleaner employed in the system shown in FIG. 1 together with its associated equipment.

An example of the tower 5 is schematically illustrated in FIG. 2 with associated lines and equipments. The cleaning water is pressurized by a pump 7 and cooled at a cooler or heat-exchanger 8 and supplied with alkali liquid from an alkali-tank 11 via a line 9 and an alkali-liquid pump 10 in order to process or neutralize harmful acid gas, particularly "HCl", and, thence, is sprayed into the tower 5 through valves 51, 52 and 53 or nozzles. The pyrolysis gas fed into the tower 5 from an inlet port 24 is passed through a straightening plate 54 so that it flows upwardly in a uniform flow and the char, absorbing agent, oil and tar, etc. contained therein are picked up by the sprayed water and then the gas is passed through a mist-separator 56 to outside so as to be directed to the utilizing facility 6 and/or the compressor 19 for fluidizing gas. The addition of alkali liquid is, in fact, auxiliary in most cases because the absorbing agent is initially charged into the reactor and the unreacted absorbing agent is also fed to the tower 5, so the water circulated in the tower tends to be stabilized at neutrality whereby it becomes substantially unnecessary to control pH. The dimension of the tower 5 may be appropriately determined depending on the consentration of tar, oil, char and harmful gas, etc. and the number of the spray valves and/or nozzles and the quantity of the sprayed water may also be adjusted accordingly. The sprayed water becomes a thin film on the inner surface of the tower 5 and flows downward so that the thin film effectively prevents the inner surface of the tower from direct contact with the oil, tar, char and absorbing agent contained in the pyrolysis gas and, thus, prevents these substances from adhering to the interior wall. The cleaning water falls down to the bottom of the tower and the part of such water containing relatively large amount of the absorbed materials is discharged to the tank 13 where the picked up materials settle in the water so as to be easily separated from the water. The materials picked up by the cleaning water include oil and tar and such materials are likely to be floating or to be suspended in the water, so they are not easily separated from the cleaning water. However, if solid items such as char and absorbing agent are also present, these solid items serve as a coagulating agent; that is, the oil and tar are attracted thereto thus promoting sedimentation of the oil and tar and reducing the amount of floating and suspended oil and tar. Therefore, although it is generally preferable to collect as much of the foreign materials at the collector 2 as possible, it is also preferable under certain conditions to feed the char and tar or the like to the tower 5 because such solid items not trapped at the collector will rapidly and effectively coagulate the oil and tar within the tower 5 so that the coagulating rate is also promoted. The recovery ratio of the solid items at the tower 5 in the system shown in FIG. 1 depends on the collecting capacity of the collector 2. That is, the smaller the particle size which can be collected by the collector 2 the lower the amount of the solid items which will be entrapped in the water in the tower 5. Therefore, controlling or reducing the amount of collecting of solid particles in the collector 2 may be preferable in view of the separation of the oil and tar from the cleaning water since the amount of solid particles is relatively increased thereby. However, for long range operation of the system, passing the gas having a high consentration of the foreign solid particles or frequent stopping and restarting of the operation with such gas may cause blockage of the heat-exchanger(s) so that the operation of the system may be governed by the condition in the heat-exchanger(s). It was found that, if the temperature of the pyrolysis gas after passing through the heat-exchanger did not drop below 350° C., the possibility of foreign particles adhering to the lines or plumbings and heat-exchangers in the system was reduced.

The char and unreacted absorbing agent are also recovered at the collector 2. Since the solid particles recovered in the collector 2 are also useful for separating the oil and tar or the like in the oil separating tank 13, an additional conveying line 16 is provided to feed the recovered char and unreacted absorbing agent from the collector 2 to the tank 13. At any rate, the collecting capacity of the collector is, of course, appropriately determined in the design for the system and depending on the expected operating conditions including the waste to be pyrolyzed. As to controlling the temperature of the pyrolysis gas, a temperature detector 42 is disposed in the line from the collector 2 to the tower 5 downstream of the heat-exchanger 3 and a signal corresponding to the temperature detected is fed to a controller 43 which controls valves 17 and 18 so as to regulate the amount of fluidizing gas bypassing the heat exchanger 3 in order to adjust fluidization in the reactor 1 depending on the temperature sensed and a fuel control valve 44 associated to the auxiliary burner 35 so as to maintain the proper temperature of the pyrolysis gas, if necessary, as well as to raise the temperature of the sand circulated from the pyrolyzer in case the amount of the char contained in the sand circulated from the pyrolyzer 1 to the incinerator 30 is not sufficient for such purpose.

The oil and tar separated in the oil separating tank 13 together with the solid particles possesses high calorific potential, for example 9000K Cal/Kg, and the char also posseses high calorific potential, for example 4000K Cal/Kg, the combination of the oil, tar, char and unreacted absorbing agent recovered from the oil separating tank 13 posseses calorific potential of approximately 5000K Cal/Kg. Therefore, this combination is recharged to the incinerator 30 through a line 14 for use in regenerating the fluidizing medium or sand. The recovered char generally carries some "Cl" so that, by supplying such char into the incinerator 30, some "HCl" will also be generated in the incinerator 30. However, the amount of "HCl" generated under such circumstance is not so large and, thus, unreacted absorbing agent mixed in the sand circulated from the pyrolyzer 1 and/or recovered absorbing agent in the collector 2 and the tank 13 will suffice to remove the "HCl" generated in the incinerator 30. Further, the combination of the recovered solid particles is a mixture of materials including absorbing agent because they are generally agitated in the separating tank 13 before sedimentation. Therefore, such absorbing agent is spread in the incinerator as the char is burnt therein whereby enough time is available for such absorbing agent to contact the harmful gas to react therewith. According to the system explained above, it will be readily understood that the present invention achieves the intended objects in that absorbing agent is effectively recovered in the system for reutilization which not only saves expense but also contributes to avoid environmental pollution and oil and tar are easily separated from the cleaning water which makes it possible to eliminate a special expensive equipment for such purpose as well as to recover as much thermal energy as possible from the waste.

Further, in the foregoing explanation, the oil and tar recovered in the oil separating tank were fed to the incinerator 30 to supplement thermal energy for regenerating the sand; however, they may be fed to the pyrolyzing reactor or pyrolyzer 1, as indicated by a line 14*a* through the feeder 21 so that they may be further pyrolyzed to increase the production of the pyrolysis gas. Since the variation in the composition of organic materials supplied is inherent and, thus, the composition is not kept constant whereby thermal energy supplied to the pyrolyzer may become excessive or insufficient. If such situation is encountered, the recovered oil and tar are appropriately fed by a distributor 60 to the pyrolyzer 1 or the incinerator 30 through lines 14*a* and 14, respectively so as to maintain stable pyrolyzing operation.

Also, the char and the unreacted agent recovered at the collector 2 may be supplied to the incinerator 30 as indicated by a chained line 16*a* depending on the design of the whole system and/or the operating condition thereof.

In the present invention, study and review were also conducted as to whether heavy metals initially contained in the waste might be condensed during the process and discharged into the draining water since those heavy metals are usually condensed to the char which is taken up by the cleaning water. However, it was revealed that the drained water according to the present invention is relatively clean and there is little fear about such problem.

The invention has been explained referring to the specific embodiment; however, it should be noted that the invention may be modified or changed by these skilled in the art within the scope and spirit of the invention which will be defined in the claims appended hereto. For instance, in the foregoing explanation, a two-bed pyrolyzing system was introduced; however, other types of thermal reactor may also be utilized in the present invention.

What is claimed:

1. In a method for the treatment of pyrolysis gas generated in a thermal reactor to eliminate harmful gas therefrom, the method comprising the steps of:

supplying absorbing agent to the reactor together with materials to be pyrolyzed;

collecting solid particles of char and unreacted absorbing agent from the pyrolysis gas fed from said reactor by a dry type collector;

feeding said gas passed through said dry type collector to a wet type gas cleaner using water for further trapping oil and tar and other minute particles still remaining in said gas;

feeding the water trapped oil, tar and minute particles to a separating tank where the trapped items are settled; and recirculating the solid particles collected at the dry type collector and the items settled in said separating tank to said reactor;

said method being characterized in that a portion of said particles collected at said collector is fed to said separating tank for promoting the separation of the oil and tar in said tank.

2. A method as claimed in claim 1 wherein the temperature of said pyrolysis gas is controlled so that it does not drop below 350° C. at an inlet of said wet type gas cleaner.

3. A system for disposing of pyrolysis gas generated by a thermal reactor to eliminate harmful gas from the pyrolysis gas comprising:

a feeder adapted to feed absorbing agent together with materials to be pyrolyzed into said reactor;

an exhaust line leading out from an upper portion of said reactor;

a dry type collector disposed in said exhaust line and adapted to collect solid particles contained in the pyrolysis gas, said solid particles being char produced during the pyrolyzing operation and unreacted absorbing agent;

a wet type gas cleaner consisting of a tower and an oil separating tank disposed in said exhaust line downstream of said collector and adapted to absorb solid particles not trapped in said dry type collector into cleaning water, said oil separating tank receiving the cleaning water including solid particles entrained therein as well as oil and tar contained in the pyrolysis gas, said solid particles, oil and tar coagulating and settling in said tank;

a supply line for supplying dry particles collected at said dry type collector to said oil separating tank;

a recirculating line for removing the coagulated mixture of said solid particles, oil and tar from said tank and for feeding said mixture to said reactor;

a temperature detector in said exhaust line upstream of said wet type gas cleaner and downstream of said dry type collector; and a control means for controlling the operation of said reactor in response to the temperature of said pyrolysis gas sensed by said detector.

* * * * *